US010069228B2

(12) United States Patent
Newman et al.

(10) Patent No.: US 10,069,228 B2
(45) Date of Patent: Sep. 4, 2018

(54) STACKING NETWORK SWITCHES

(71) Applicant: HEWLETT PACKARD ENTERPRISE DEVELOPMENT LP, Houston, TX (US)

(72) Inventors: Jerry R. Newman, Austin, TX (US); Jeffrey Sung, Houston, TX (US); Justin E. York, Houston, TX (US); Chanh V. Hua, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 48 days.

(21) Appl. No.: 15/021,825

(22) PCT Filed: Sep. 30, 2013

(86) PCT No.: PCT/US2013/062635
§ 371 (c)(1),
(2) Date: Mar. 14, 2016

(87) PCT Pub. No.: WO2015/047397
PCT Pub. Date: Apr. 2, 2015

(65) Prior Publication Data

US 2016/0285185 A1 Sep. 29, 2016

(51) Int. Cl.
*H01R 12/73* (2011.01)

(52) U.S. Cl.
CPC ..... *H01R 12/737* (2013.01); *H01R 2201/06* (2013.01)

(58) Field of Classification Search
CPC .... H01R 23/725; H01R 23/722; H01R 9/096; G02B 6/4249; G02B 6/4292
USPC ..... 439/74, 65; 385/89
See application file for complete search history.

(56) References Cited

U.S. PATENT DOCUMENTS 5,111,200 A 5/1992 Jasmer et al.
5,836,785 A * 11/1998 Lee ..... G06F 12/0676 439/489
5,907,475 A * 5/1999 Babinski ..... H05K 1/14 361/719
6,793,539 B1 9/2004 Lee et al.
7,056,128 B2 * 6/2006 Driscoll ..... H01R 23/688 439/65

(Continued)

FOREIGN PATENT DOCUMENTS

WO WO-2008112089 9/2008

OTHER PUBLICATIONS

International Search Report and Written Opinion dated Jun. 23, 2014, PCT Patent Application No. PCT/US2013/062635 filed Sep. 30, 2013, Korean Intellectual Property Office.

(Continued)

*Primary Examiner* — Gary Paumen
(74) *Attorney, Agent, or Firm* — Hewlett Packard Enterprise Patent Department

(57) ABSTRACT

A stacking connector is provided herein. The stacking connector includes a first plurality of pins, a second plurality of pins and a set of wires. The first plurality of pins to connect to a first network switch. The second plurality of pins to connect to a second network switch. The set of wires to couple the first plurality of pins to the second plurality of pins. The first plurality of pins and the second plurality of pins to stack the first network switch and the second network switch.

13 Claims, 8 Drawing Sheets

(56) References Cited

U.S. PATENT DOCUMENTS

| | | | | |
|---|---|---|---|---|
| 7,748,992 | B1 | 7/2010 | Wooley et al. | |
| 7,792,104 | B2 | 9/2010 | Tzeng | |
| 7,905,729 | B2 * | 3/2011 | Goosens | H01R 29/00 439/61 |
| 8,102,630 | B2 | 1/2012 | Abdul Kader Jailani | |
| 8,107,466 | B2 | 1/2012 | Huang et al. | |
| 8,746,989 | B2 * | 6/2014 | Yeo | G02B 6/43 385/89 |
| 2005/0085103 | A1 | 4/2005 | Driscoll et al. | |
| 2008/0207011 | A1 | 8/2008 | Goosens | |
| 2009/0097803 | A1 | 4/2009 | Yeo | |
| 2014/0065848 | A1 * | 3/2014 | Chang | H01R 12/50 439/65 |
| 2014/0273551 | A1 * | 9/2014 | Resendez | H01R 12/737 439/65 |

OTHER PUBLICATIONS

Love, J.; 10-GB Ethernet Transceiver Lowers Cost of Stacking Links ; http://www.eetimes.com/document.asp?doc_id=1296595 >; Jun. 27, 2005.

* cited by examiner

STACKING NETWORK SWITCHES

CLAIM FOR PRIORITY

The present application is a national stage filing under 35 U.S.C. § 371 of PCT application number PCT/US2013/062635, having an international filing date of Sep. 30, 2013, the disclosure of which is hereby incorporated by reference in its entirety.

BACKGROUND

Network switches are stacked together in integrated systems. A stacking link connects two network ports of two network switches together to increase the bandwidth. Traditionally, expensive cables are used to form a stacking link. Not only are the cables expensive, but the cables use valuable faceplate ports, which reduced the potential performance of the network

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

Figure 1:
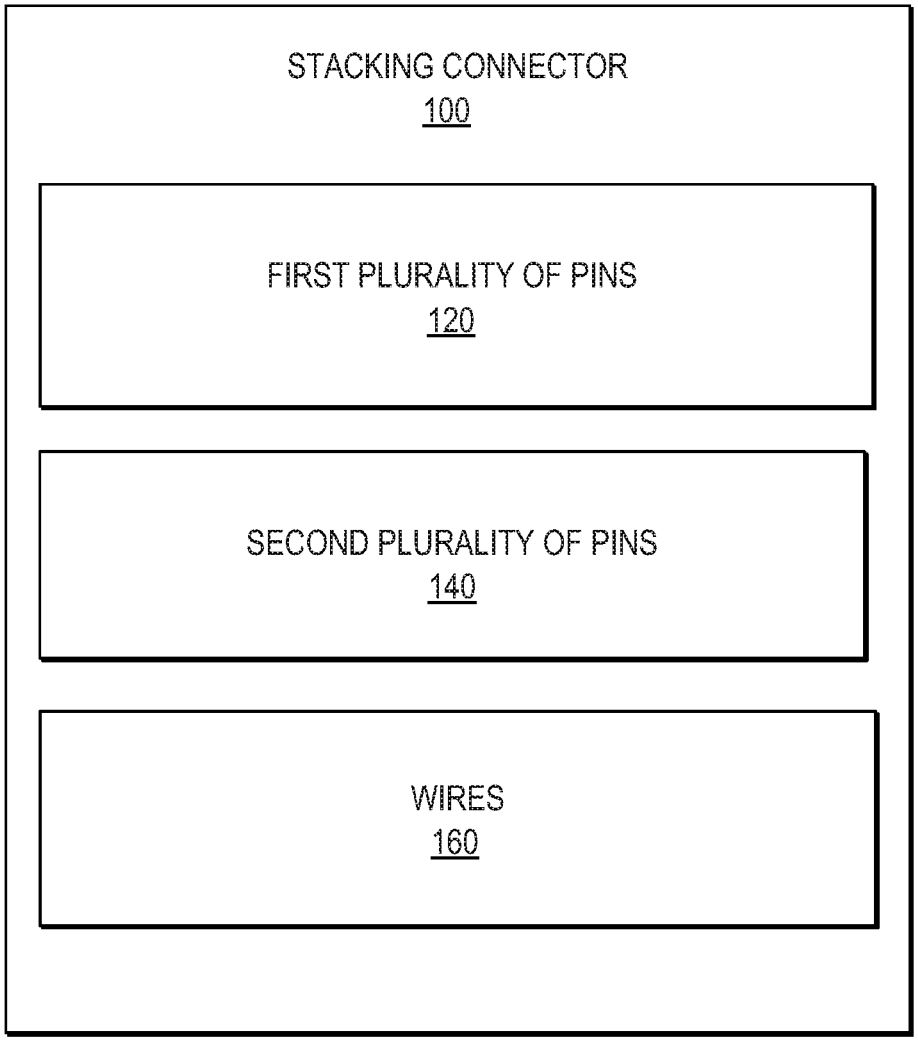
FIG. 1 illustrates a block diagram of a stacking connector to connect two network switches according to an example.

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure.

In examples, a stacking connector to connect two network switches is provided. The stacking connector includes a first plurality of pins and a second plurality of pins, a set of wires. The first plurality of pins to connect to a first network switch. The second plurality of pins to connect to a second network switch. The set of wires to couple the first plurality of pins to the second plurality of pins. The first plurality of pins and the second plurality of pins to stack the first network switch and the second network switch.

As used herein, the phrase "plurality of pins or PCB connector" refers to a high speed connector, such as a peripheral component interconnect express (PCIe) connector pin.

As used herein, the phrase "compute system" refers to a combination of electronic components, such as electronic components usable with a server, blade server, or server cartridge that provide computer solutions, storage solutions, network solutions and/or cloud services.

As used herein, the phrase "stacking connector" refers to a connection formed through a plurality of pins, such as PCIe connector pins. The stacking connector may be enclosed by a computing cartridge and/or formed of unused pins of a compute system.

As used herein, the term "wire" refers to an electronic connection formed of a copper trace or an optical fiber.

As used herein, the phrase "printed circuit assembly" refers to a printed circuit board with electronic components connected thereto.

As used herein, the phrase "baseboard" refers to a printed circuit board in a chassis, such as a motherboard that is formed to receive electronic components.

As used herein, the term "slot" refers to a physical or logical separation formed between connections on a baseboard. For example, a slot with a physical separation may be used to align electronic components and/or stacking connector on the baseboard. A slot with a logical separation may be used to identify a portion or connection on the baseboard.

As used herein, the phrase "baseboard connector" refers to a connector on the baseboard formed to receive a plurality of pins.

As used herein, the phrase "switch connector" refers to a high speed connector on a network switch formed to receive a network connector on the baseboard.

As used herein, the phrase "network connector" refers to a connector on the baseboard formed to receive a switch connector.

As used herein, the phrase "board connection" refers to a connection on a baseboard that connects multiple plurality of pins on the baseboard to one another via, for example, wires, copper traces, and/or optical fibers. For example, the board connection connects a baseboard connector to a network connector.

FIG. 1 illustrates a block diagram of a stacking connector to connect two network switches according to an example. The stacking connector 100 includes a first plurality of pins 120, a second plurality of pins 140, and a set of wires 160. The first plurality of pins 120 to connect to a first network switch. The second plurality of pins 140 to connect to a second network switch. The set of wires 160 to couple the first plurality of pins 120 to the second plurality of pins 140. The first plurality of pins 120 and the second plurality of pins 140 to stack the first network switch and the second network switch.

Figure 2:
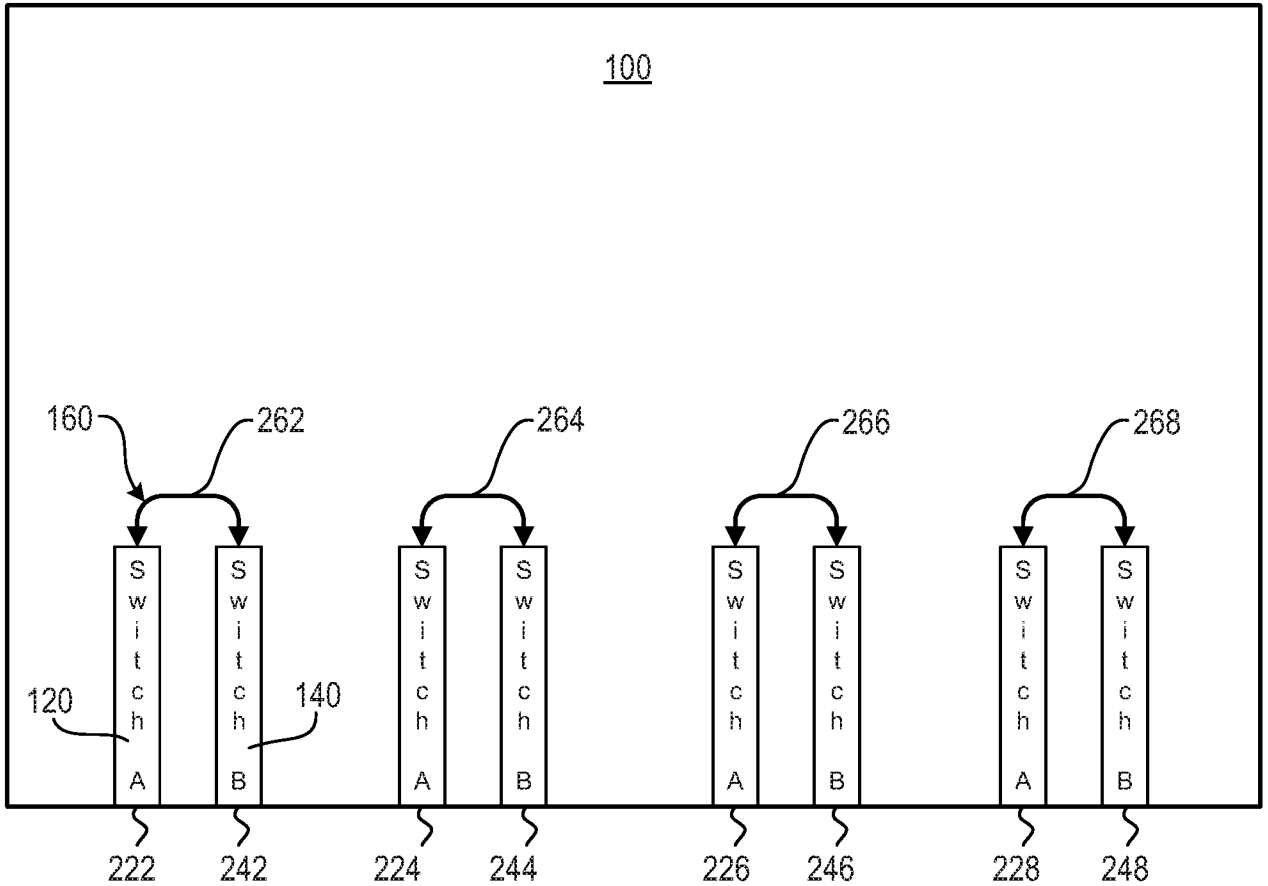
FIG. 2 illustrates a schematic diagram of a portion of the stacking connector of FIG. 1 according to an example.

FIG. 2 illustrates a schematic diagram of a portion of the stacking connector 100 of FIG. 1 according to an example. In FIG. 2, the stacking connector 100 is illustrated as a printed circuit board. The stacking connector 100 includes the first plurality of pins 120 connected to a network switch A. Similarly, the second plurality of pins 140 are connected to a switch B. The first plurality of pins 120 may include a first set of PCIe connector pins to connect to a baseboard. The second plurality of pins 140 may include a second set of PCIe connector pins to connect to the baseboard.

For example, the first plurality of pins 120 includes a first set of four PCIe connectors pins on the stacking connector 100 to connect to switch A, i.e., a first connector pin 222, a second connector pin 224, a third connector pin 226, and a fourth connector pin 228. Similarly, the second plurality of pins 140 are connected to switch B via a second set of four pins, i.e., a fifth connector pin 242, a sixth connector pin 244, a seventh connector pin 246, an eighth connector pin 248. Each connector of the first set of four plurality of pins 222, 224, 226, 228 are connected to one of the second set of four pins 242, 244, 246, 248 via the set of wires 160. As illustrated, the first connector pin 222 is connected to the fifth connector pin 242 via a first wire 262. The second connector pin 224 is connected to the sixth connector pin 244 via the second wire 264. The third connector pin 226 is connected to the seventh connector pin 246 via the third wire 266. The fourth connector pin 228 is connected to the eighth connector pin 248 via the fourth wire 268.

The set of wires 160 may include, for example, a copper trace or an optical fiber. The set of wires 160 may also include various connector types, such as a single ended connection or a differential connection. The stacking connector 100 is usable with a variety of configurations, such as a blade form factor server, a server cartridge, and/or a storage cartridge. Referring to FIG. 2, the use of the plurality of pins may be either on a printed circuit board dedicated to stacking network switches or a set of "extra" pins on a server or storage cartridge. Both cases enable the stacking to occur internal a computing system having a common baseboard or motherboard. Internal stacking provides performance advantages by saving valuable faceplate ports and improving the bandwidth.

Figure 3:
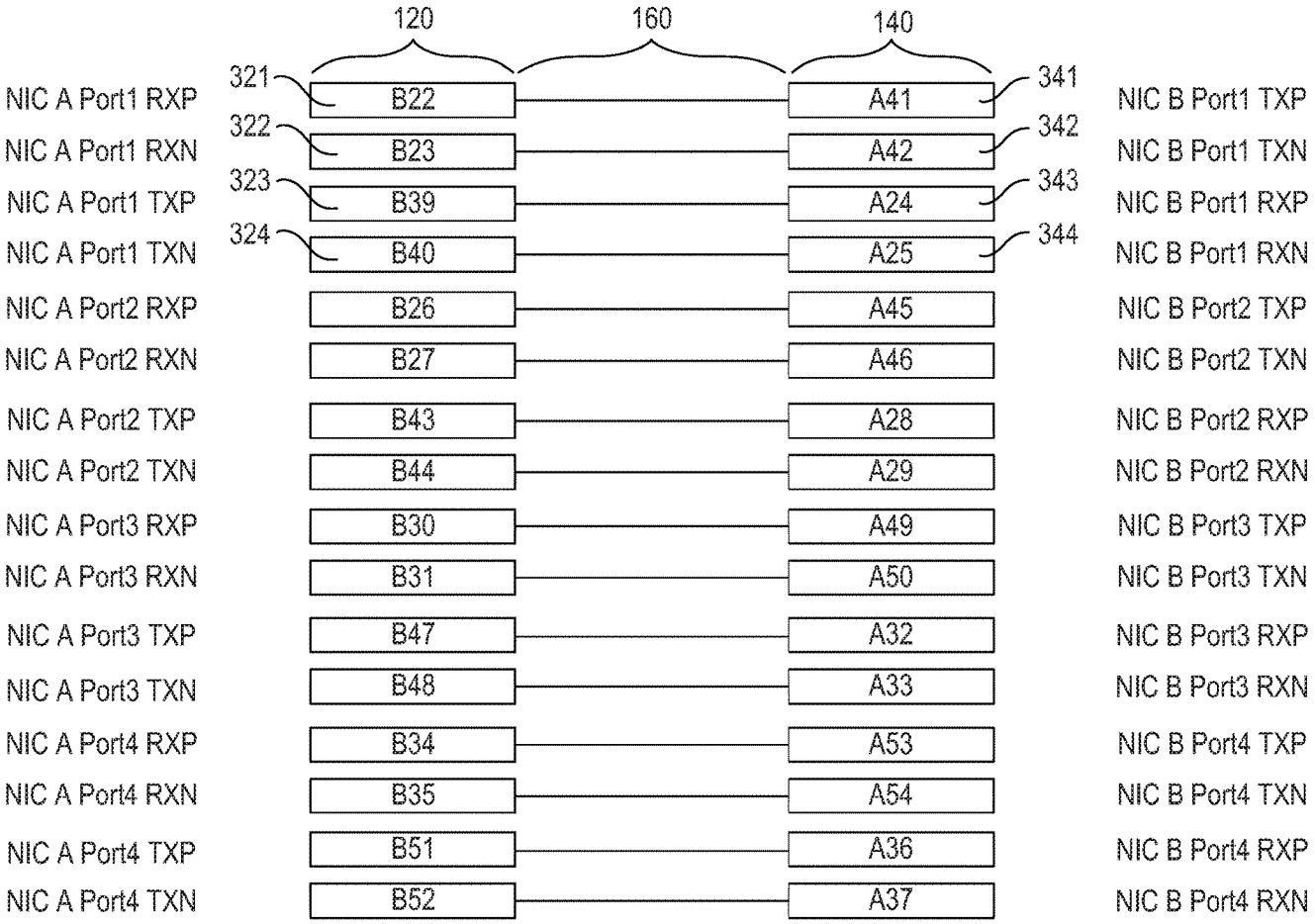
FIG. 3 illustrates a schematic diagram of the stacking connector of FIG. 1 according to an example.

FIG. 3 illustrates a schematic diagram of the stacking connector 100 of FIG. 1 according to an example. FIG. 3 illustrates the wires 160 between the first and second plurality of pins 120, 140 as PCIe connector pins. Each set of PCIe connector pins is associated with the first or the second plurality of pins 120, 140. The PCIe connector pins of the first plurality of pins 120 connects to a first network switch and includes a first positive receiving pin 321, a first negative receiving pin 322, a first positive transmission pin 323, and a first negative transmission pin 324. The PCIe connector pins of the second plurality of pins 140 connect to a second network switch and include a second positive transmission pin 341, a second negative transmission pin 342, a second position receiving pin 343, and a second negative receiving pin 344.

The PCIe connector pins are connected to one another via the set of wires 160 as illustrated in FIG. 3. For example, the first positive receiving pin 321 is connected to the second positive transmission pin 341. The first negative receiving pin 322 is connected to the second negative transmission pin 342. The first positive transmission pin 323 is connected to the second positive receiving pin 343. The first negative transmission pin 324 is connected to the second negative receiving pin 344.

Figure 4:
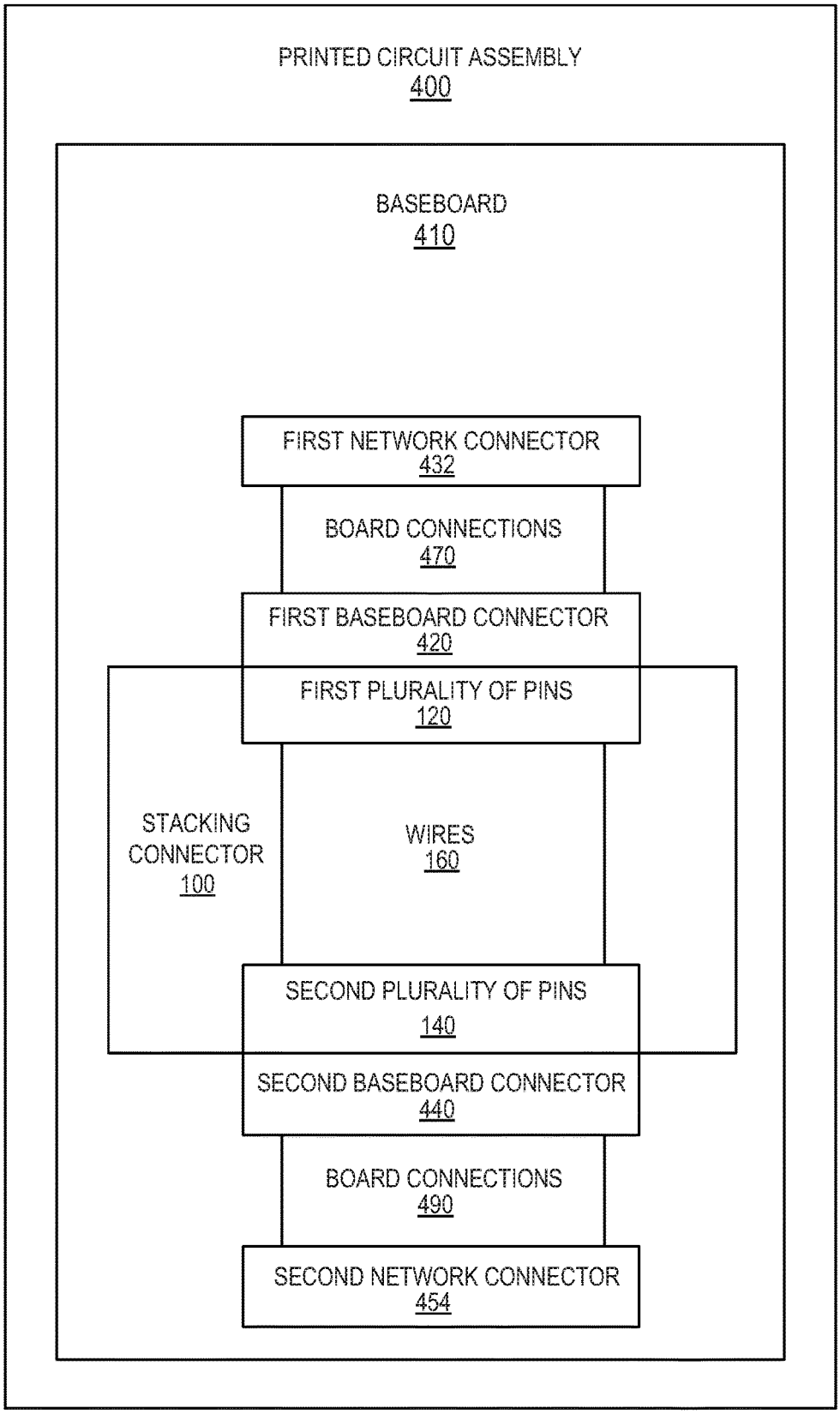
FIG. 4 illustrates a block diagram of an assembly to connect two network switches.

FIG. 4 illustrates a block diagram of an assembly 400 to connect two network switches. The assembly 400 may include for example a printed circuit assembly. The assembly 400 includes a baseboard 410 and a stacking connector 100. The baseboard 410 includes: at least two network connectors, at least two baseboard connectors, and a plurality of board connections that connect the at least two network connectors to the at least two baseboard connectors. For example, the at least two network connectors include a first network connector 432 connected to a first network switch and a second network connector 454 connected to a second network switch. The at least two baseboard connectors include a first baseboard connector 420 and a second baseboard connector 440 on the baseboard to receive the stacking connector 100. The plurality of board connections include a first board connection 470 between the first baseboard connector 420 and the first network connector 432, and the second board connection 490 between the second baseboard connector 440 and the second network connector 454. The plurality of board connections may include additional board connections for various electronic components and may be formed of wires, copper traces, and/or optical fibers.

A stacking connector 100 is connected to the at least two baseboard connectors. The stacking connector 100 includes a first plurality of pins 120, a second plurality of pins 140, and a set of wires 160. The first plurality of pins 120 connects to a first network switch via the first baseboard connector 420. The second plurality of pins 140 to connect to a second network switch via the second baseboard connector 440. The set of wires 160 on the stacking connector 100 to connect the first plurality of pins 120 to the second plurality of pins 140. The first plurality of pins 120 and the second plurality of pins 140 to stack the first network switch and the second network switch.

Figure 5:
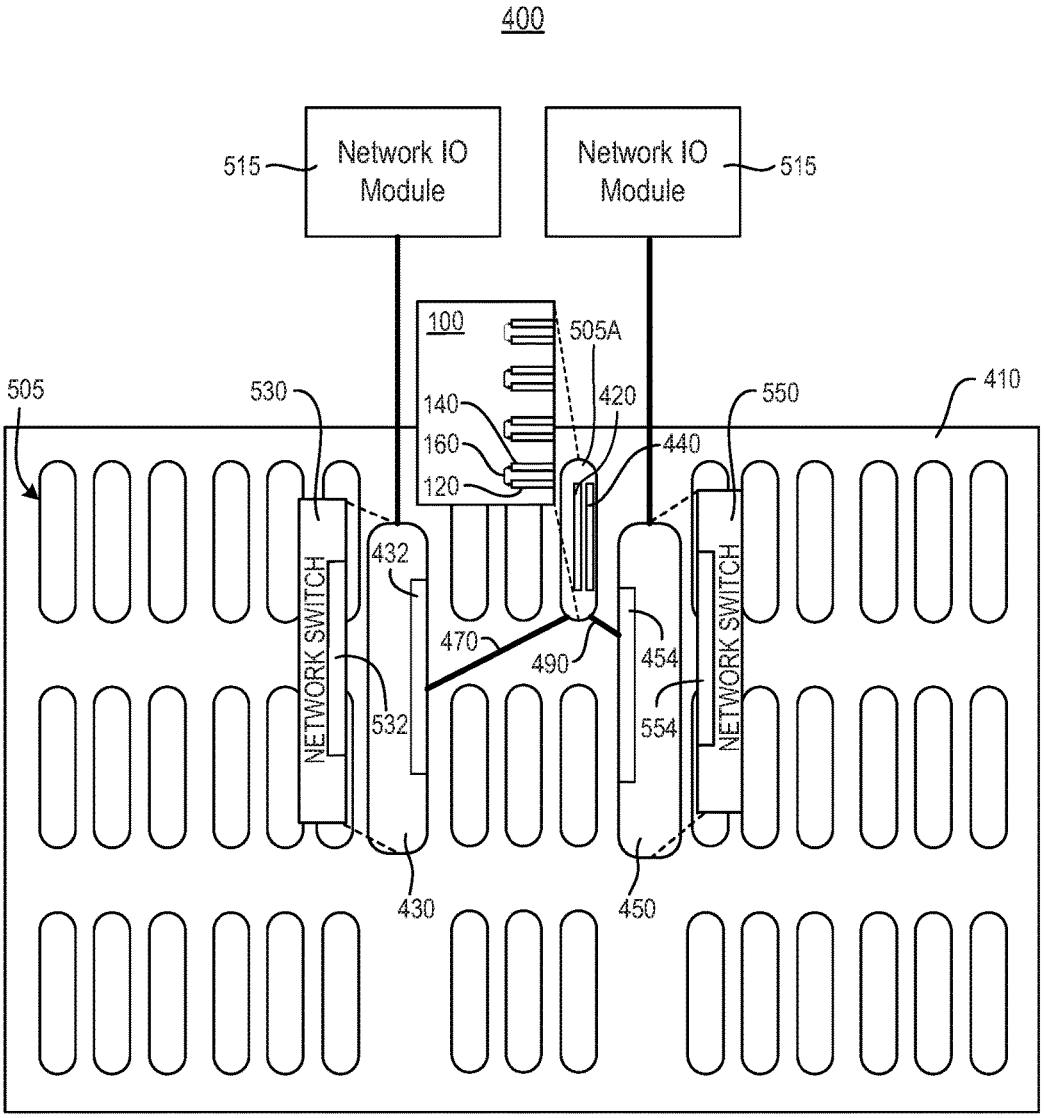
FIG. 5 illustrates a perspective diagram of the assembly of FIG. 4 according to an example.

FIG. 5 illustrates a perspective diagram of the assembly 400 of FIG. 4 according to an example. The assembly 400 as illustrated to include the baseboard 410 as a printed circuit board, such as a motherboard. The printed circuit board of the baseboard 410 is distinct from the printed circuit board may form the stacking connector 100. The assembly 400 further includes an array of slots 505 aligned with the baseboard 410 such that at least one slot 505A of the array of slots 505 aligns with the first baseboard connector 420 and the second baseboard connector 440. The baseboard 410 further includes a first network connector 432 connected to a first network switch 530 and a second network connector 454 connected to a second network switch 550. The first board connection 470 is illustrated between the first baseboard connector 420 and the first network connector 432, and the second board connection 490 is illustrated between the second baseboard connector 440 and the second network connector 454. The board connections may be formed of wires, copper traces, and/or optical fibers.

The first network switch 530 includes a first switch connector 532 to connect the first network switch 530 to the first board connection 470 via the first network connector 432. The second network switch 550 includes a second switch connector 554 to connect the second network switch 550 to a second board connection 490 via a second network connector 454.

A stacking connector 100 is connected to the baseboard 410. The first plurality of pins 120 connects to a first network switch 530 via the first baseboard connector 420. The second plurality of pins 140 connects to a second network switch 550 via a second baseboard connector 440. The set of wires 160 on the stacking connector 100 to connect the first plurality of pins 120 to the second plurality of pins 140.

The assembly 400 uses the stacking connector 100 to reduce the cost since expensive cables are no longer needed to stack two network switches. The stacking connector 100 also provides an easier way to stack two network switches together when the network switches are internal to or attached to the assembly 400. For example, one of the external uplink ports 515 is not necessary to stack the two network switches 530, 550. The availability of one of the external uplink ports 515 provides the ability to add a network connection to a top of rack switch or an edge switch, which allows an increase in the bandwidth performance of traffic passing through the switch.

Figure 6:
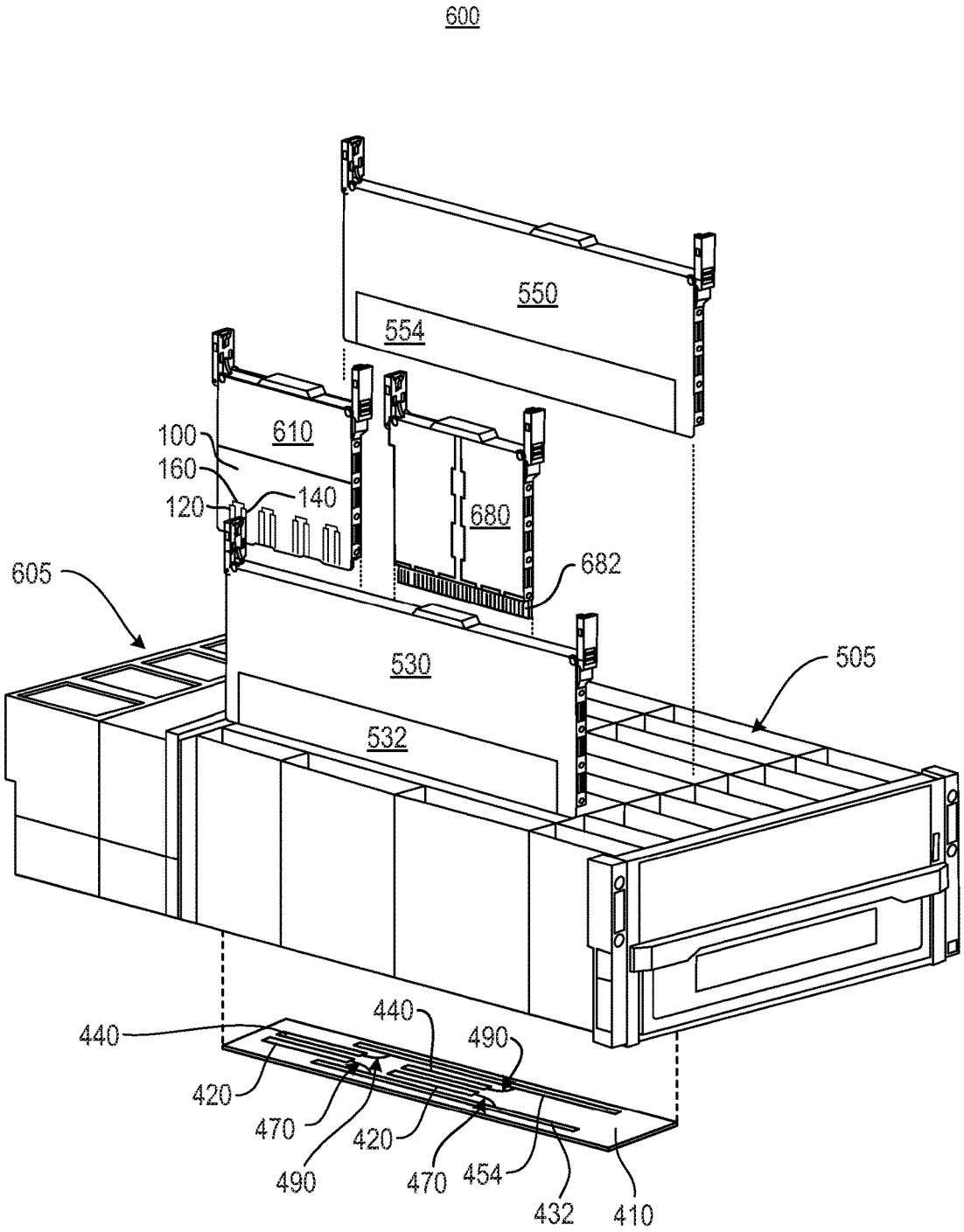
FIG. 6 illustrates a perspective diagram of a system usable with the assembly of FIG. 4 according to an example.

FIG. 6 illustrates a perspective diagram of a compute system usable with the assembly of FIG. 3 according to an example. The compute system 600 includes a chassis 605, a baseboard 410, a first and a second network switch 530, 550, and two cartridges 610, 680. The chassis 605 includes an array of slots 505. The array of slots 505 are formed with at least one slot aligning with the first and second baseboard connectors 420, 440. The baseboard 410 includes the first and second baseboard connectors 420, 440, and a first and second network connector 432, 454 to connect to the first and second network switches 530, 550 via the first and second switch connectors 532, 554 respectively. The first baseboard connector 420 is illustrated as connected to the first network connector 432 through the first board connection 470. Similarly, the second baseboard connector 440 is illustrated as connected to the second network connector 454 through the second board connection 490.

The first network switch 530 includes the first switch connector 532 and the second network switch 550 includes the second switch connector 554. One of the cartridges 610 includes the stacking connector 100 with the first plurality of pins 120, the second plurality of pins 140, and the set of wires 160. The cartridge 610 is illustrated as a separate cartridge that holds the stacking connector 100 to stack the network switches and no other electronic components. The stacking connector 100 may be an additional printed circuit board added to the cartridge or extra space on a printed circuit board on the cartridge that is used for stacking the network switches. For example, cartridge 680 is illustrated as a generic cartridge and may include a compute module containing one or a combination of, the stacking connector 100, hard drives, processors, and heat sinks. The first plurality of pins 120 and the second plurality of pins 140 to connect to a set of unused baseboard connectors 420, 440, such as a network interface controller card 682 on the other cartridge 680.

The cartridges 610, 680 are illustrated as top-loading server cartridges according to an example; however the chassis may also be formed to receive other cartridges, such as a traditional blade form factor servers. The stacking connector 100 is not dependent on a specific type of server or compute system. For example, the blade form factor servers would similarly receive the stacking connector 100 as an additional or unused printed circuit board.

Figure 7:
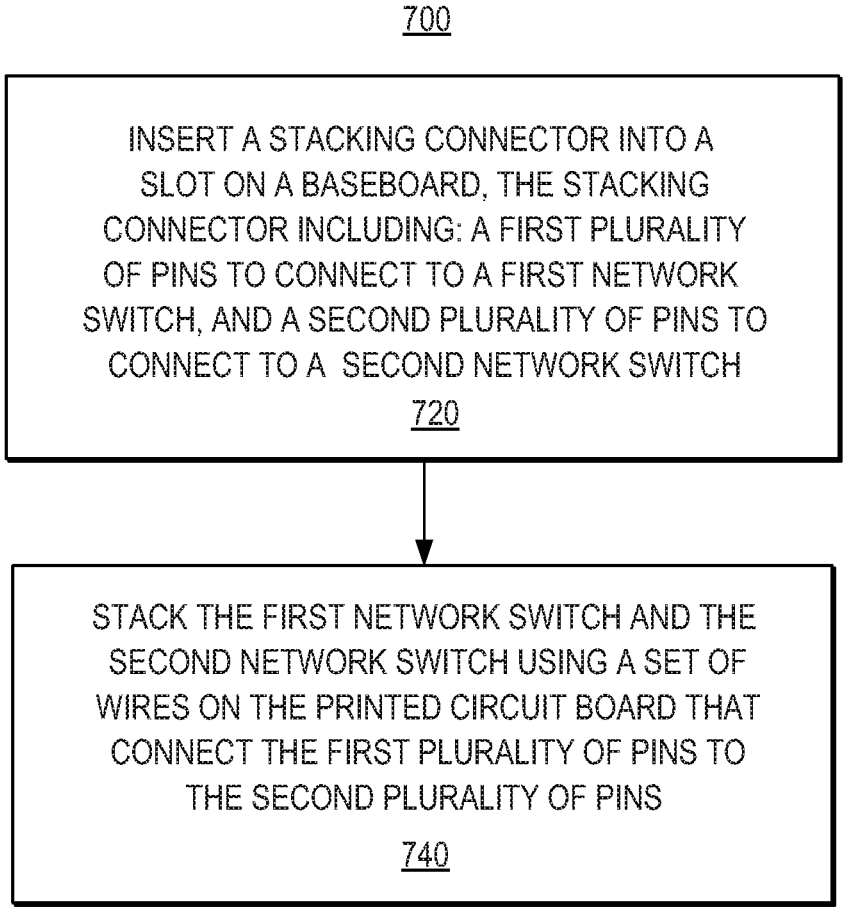
FIGS. 7-9 illustrate flow charts of methods to stack two network switches using an assembly according to examples.
Figure 8:
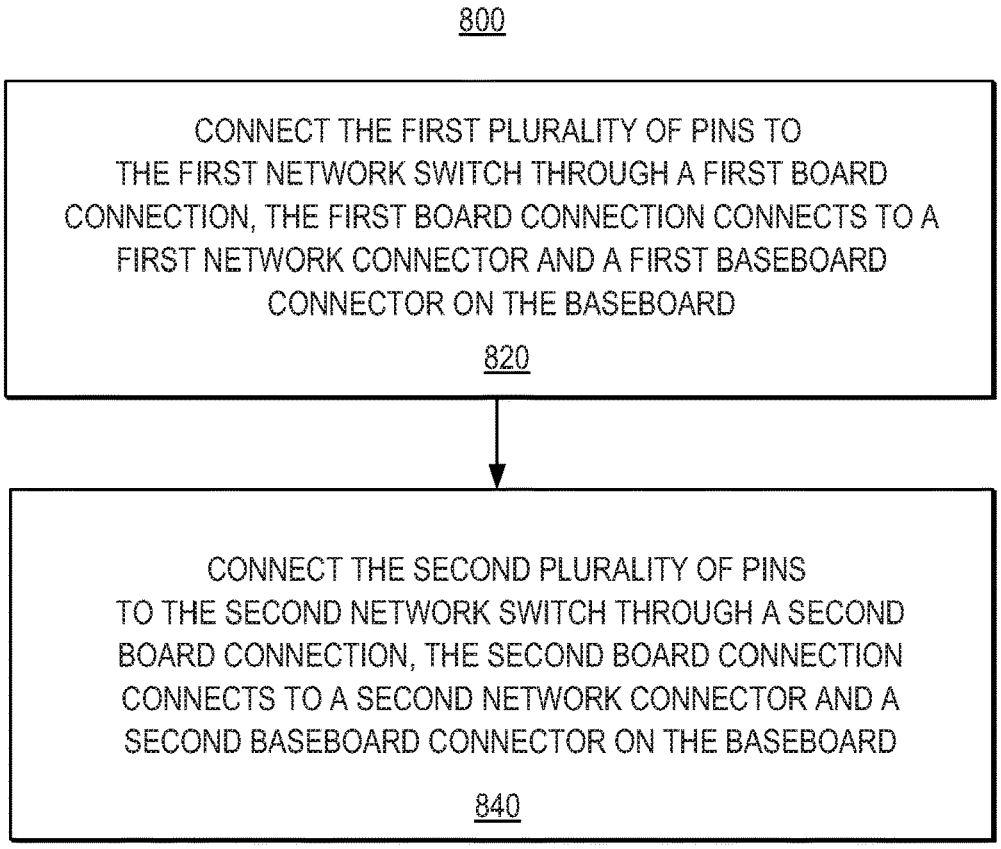
Figure 9:
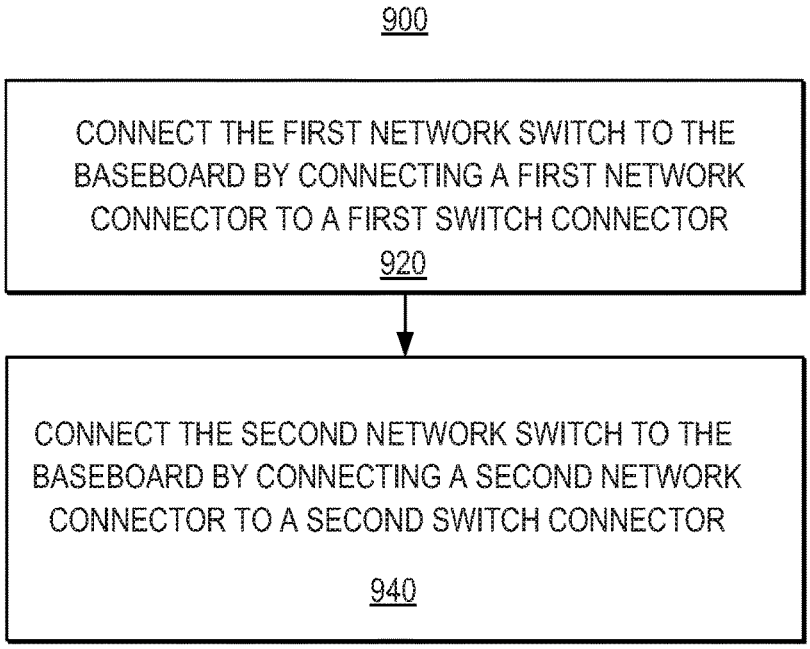

FIGS. 7-9 illustrate flow charts 700, 800, 900 of methods to stack two network switches according to examples. FIG. 7 illustrates a flow chart 700 of the method to stack two network switches. In block 720, a stacking connector is inserted into a slot on a baseboard. The stacking connector includes a first plurality of pins, a second plurality of pins. The first plurality of pins connects to a first network switch. The second plurality of pins connects to a second network switch. In block 740, the two network switches are stacked using a set of wires to couple the first plurality of pins to the second plurality of pins. For example, the first and the second plurality of pins may be formed on a printed circuit board that is part of a server or storage cartridge that has a server or storage functionality in addition to stacking the network switches, or it may be a separate printed circuit board that in a cartridge with the sole purpose of stacking the network switches The flow chart 800 of FIG. 8 illustrates that the first plurality of pins are connected to the first network switch through a first board connection in block 820. The first board connection connects to a first network connector and a first baseboard connector on the baseboard. In block 840, the second plurality of pins connect to the second network switch through a second board connection. The second board connection connects to a second network connector and a second baseboard connector on the baseboard.

Referring to FIG. 9, the flow chart 900 further illustrates the method to connect the first network switch to the baseboard in block 920. The first network switch is connected to the baseboard by connecting a first network connector to a first switch connector. Similarly, in block 940, the second network switch is connected to the baseboard by connecting a second network connector to a second switch connector.

Although the flow diagrams 700, 800, 900 of FIGS. 7-9 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present invention.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An assembly to connect two network switches in a compute system, the assembly comprising:

a baseboard including:

at least two network connectors, at least two baseboard connectors, and a plurality of board connections that connect the at least two network connectors to the at least two baseboard connectors; and a stacking connector including:

a first plurality of pins to connect to a baseboard connector of the at least two baseboard connectors to interface with a first network switch connected to a network connector of the at least two network connectors;

a second plurality of pins to connect to another baseboard connector of the at least two baseboard connectors to interface with a second network switch connected to another network connector of the at least two network connectors; and a set of wires to couple the first plurality of pins to the second plurality of pins, the first plurality of pins and the second plurality of pins to stack the first network switch and the second network switch, wherein the stacking connector is arranged in a slot that is aligned with the baseboard connector and the another baseboard connector of the at least two baseboard connectors.

2. The assembly of claim 1, further comprising:

a first network switch including a first switch connector to connect the first network switch to a first board connection via a first network connector; and a second network switch including a second switch connector to connect the second network switch to a second board connection via a second network connector.

3. The assembly of claim 1, further comprising an array of slots aligned with the baseboard, wherein the slot is within the array of slots.

4. The assembly of claim 1, further comprising a storage cartridge to connect to the baseboard, the storage cartridge including the first plurality of pins and the second plurality of pins.

5. The assembly of claim 1, further comprising a server cartridge, the server cartridge includes the stacking connector.

6. A method to stack two network switches comprising:

inserting a stacking connector into a slot on a baseboard;

connecting a first plurality of pins of the stacking connector to a first baseboard connector to interface with a first network switch;

connecting a second plurality of pins of the stacking connector to a second baseboard connector to interface with a second network switch; and stacking the first network switch and the second network switch using a set of wires on the stacking connector to couple the first plurality of pins to the second plurality of pins.

7. The method of claim 6, further comprising:

connecting the first plurality of pins to the first network switch through a first board connection, the first board connection connects to a first network connector and a first baseboard connector on the baseboard; and connecting the second plurality of pins to the second network switch through a second board connection, the second board connection connects to a second network connector and a second baseboard connector on the baseboard.

8. The method of claim 6, further comprising:

connecting the first network switch to the baseboard by connecting a first network connector to a first switch connector; and connecting the second network switch to the baseboard by connecting a second network connector to a second switch connector.

9. The method of claim 6, wherein the stacking connector resides within a server cartridge.

10. The method of claim 6, wherein the first plurality of pins comprises a first set of peripheral component interconnect express (PCIe) connector pins, and the second plurality of pins comprises a second set of PCIe connector pins.

11. The method of claim 6, wherein the set of wires comprises a set of copper traces.

12. The method of claim 6, wherein the set of wires comprises a single ended connection.

13. The method of claim 6, wherein the set of wires comprises a differential connection.

* * * * *